United States Patent [19]

Russo

[11] 4,196,339

[45] Apr. 1, 1980

[54] HEATING APPARATUS FOR FORMING LAMINATED PLASTIC

[76] Inventor: George J. Russo, 175 French Hill Rd., Wayne, N.J. 07470

[21] Appl. No.: 899,731

[22] Filed: Apr. 25, 1978

[51] Int. Cl.[2] ..... H05B 1/02

[52] U.S. Cl. ..... 219/243; 72/342; 219/227; 219/523; 219/530; 156/196; 156/272; 264/322; 425/392

[58] Field of Search ..... 219/243, 154, 254, 255, 219/244, 245, 385, 227, 222, 386, 523, 530; 235/427, 423; 425/391, 392, 384; 65/281; 72/342, DIG. 12; 431/61; 156/192, 272; 264/322; 144/256; 215/13 R

[56] References Cited

U.S. PATENT DOCUMENTS

| | | | |
|---|---|---|---|
| 1,330,804 | 2/1920 | Haskell et al. | 144/256 |
| 2,433,643 | 12/1947 | Beach et al. | 264/322 |
| 2,480,774 | 8/1949 | Rossheim et al. | 72/342 |
| 2,739,218 | 3/1956 | Wennerlund | 219/530 X |
| 2,742,387 | 4/1956 | Giuliani | 215/13 R |
| 2,808,501 | 10/1957 | Kilpatrick et al. | 219/154 |
| 3,184,796 | 5/1965 | Southcott et al. | 425/384 |
| 3,340,714 | 9/1967 | Pohl et al. | 72/342 |
| 3,419,939 | 1/1969 | Shelby | 219/243 X |
| 3,472,005 | 10/1969 | Grandinetti | 219/222 |
| 3,965,808 | 6/1976 | Chomette | 219/523 X |

*Primary Examiner*—Volodymyr Y. Mayewsky
*Attorney, Agent, or Firm*—Ralph R. Roberts

[57] ABSTRACT

This invention pertains to the forming of a laminated plastic such as Formica (trademark of Formica Corporation) having a decorative facing layer. A controlled heating cylindrical column of metal is provided. This cylindrical column is secured to a base which may be secured to a workbench or the like. A control apparatus is also provided which includes an "on-off" switch, a temperature indicator, a variable voltage or current control and an indicator light for determining when the apparatus is in operation.

7 Claims, 2 Drawing Figures

HEATING APPARATUS FOR FORMING LAMINATED PLASTIC

BACKGROUND OF THE INVENTION

1. Field of the Invention

With reference to the classification of art as established in and by the U.S. Patent and Trademark Office this invention is believed to belong in the general Class entitled, "Electric Heating" (Class 219) and the subclasses entitled, "bending or twisting" (subclass 153) and "subsequent to heating" (subclass 154).

2. Discussion of the Prior Art

The heating of laminated material in shaping of counter tops prior to their gluing to a base is well known. The patents directed to the heating of a laminated material, insofar as known, are of a specific nature. The Applicant has been involved in cabinet making for more than thirty years and in particular with kitchen cabinets and baths where laminated decorative surfaces are disposed to the exposed or outer surfaces.

In a review of the prior art patents the following references were noted: U.S. Pat. No. 1,330,804 to HASKELL et al. of Feb. 17, 1920 pertains to welding laminates. U.S. Pat. No. 2,433,643 to BEACH et al. of Dec. 30, 1947 shows the forming of phenolic sheet in a closed mold. U.S. Pat. No. 2,480,744 to ROSSHEIM et al. as issued on Aug. 30, 1949 shows a heating collar that surrounds a plastic tube or rod for bending. In U.S. Pat. No. 2,742,387 to GIULIANI on Apr. 17, 1956 there is shown a closed mold with upper and lower heating means for making a radar reflector. U.S. Pat. No. 2,808,501 to KILPATRICK et al. on Oct. 1, 1957 shows heating of a strip by applying an electric current through the material. U.S. Pat. No. 3,184,796 to SOUTHCOTT et al. as issued on May 25, 1965 shows apparatus for bending plastic pipe. U.S. Pat. No. 3,340,714 to POHL et al. as issued on Sept. 12, 1967 shows a heated closed mold for shaping laminated material. In these prior art devices and so far as is known in commercially available devices, the providing of a heated metal cylinder of small diameter secured to a workbench is novel. So as to accommodate laminates of various thickness and/or different compositions a variable resistance and a temperature indicator is also provided.

SUMMARY OF THE INVENTION

This invention may be summarized at least in part with reference to its objects.

It is an object of this invention to provide, and it does provide, a laminate heating device in which a relatively small diameter metal cylinder is secured to a base for mounting to a bench or the like. This cylinder is electrically heated to provide an open form against which the laminated portion is brought to a locally warm temperature for bending to a desired shaping.

It is a further object to provide, and it does provide, a laminate heating device in which the metal cylinder is heated electrically and the amount or degree of heat is varied by an electrical resistance and this degree of heat is measured by a thermometer device.

In addition to the above summary the following disclosure is detailed to insure adequacy and aid in understanding of the invention. This disclosure, however is not intended to cover each concept therein no matter how it may later be disguised by variations in form or additions of further improvements. For this reason there has been chosen a specific embodiment of the heating apparatus for forming laminated plastic as adopted for use in heating and binding laminated plastic and showing a preferred means for arranging the components for open forming. This specific embodiment has been chosen for the purposes of illustration and description as shown in the accompanying drawing wherein:

Figure 1:
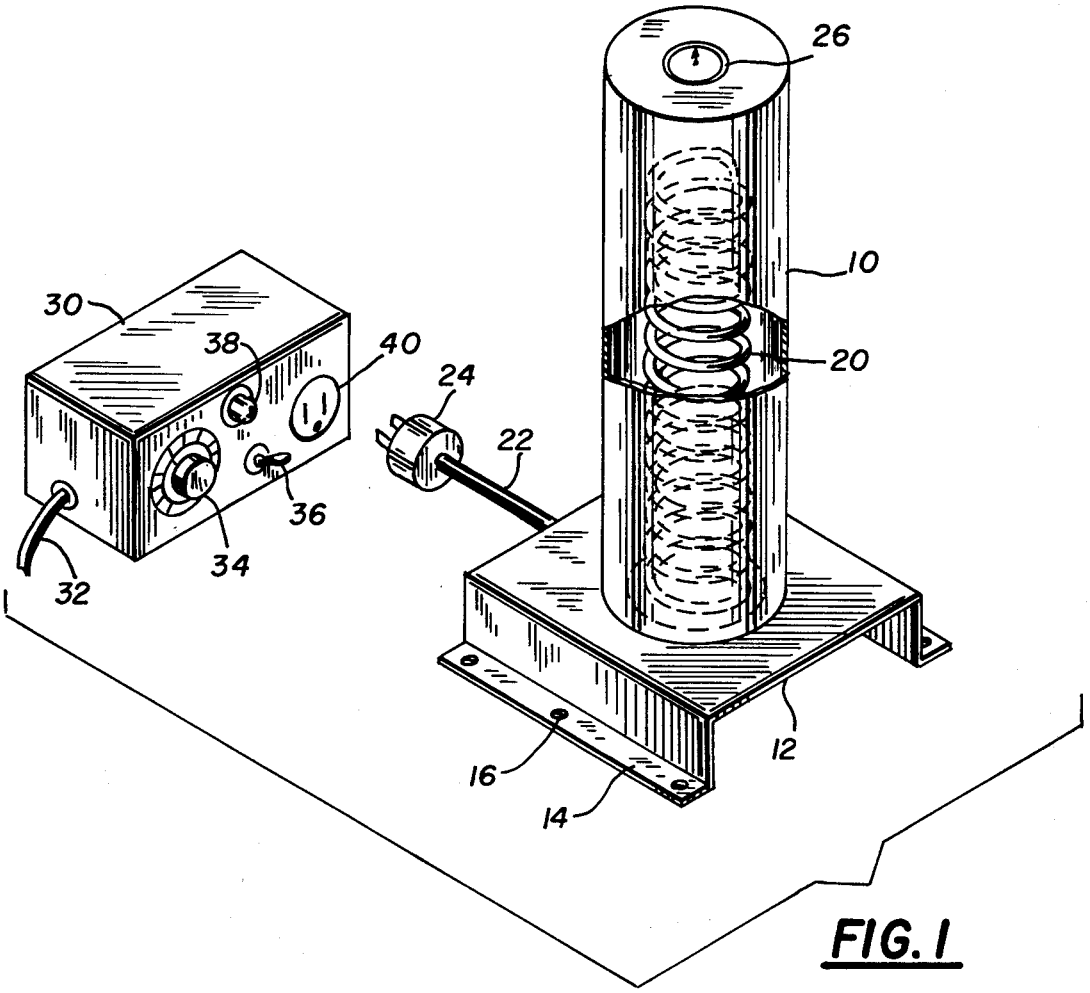
FIG. 1 represents an isometric view of the laminate heating apparatus of this invention and showing the preferred arrangement of the several components providing this combination, a portion of the tubular wall is broken away.

In the following description and in the claims various details are identified by specific names for convenience, these names, however, are intended to be generic in their application.

The drawing accompanying, and forming part of, this specification discloses certain details of construction for the purpose of explanation but it should be understood that these structural details may be modified and that the invention may be incorporated in other structural forms than shown.

DESCRIPTION OF THE APPARATUS OF FIG. 1

Referring now to the drawing and in particular to FIG. 1, there is shown a preferred arrangement of the laminate heating apparatus. A length of aluminum pipe or tubing 10, may be about two inches (50.8 mm.) in outside diameter and about five to nine inches in length (127.0 to 228.6 mm.). This tubing may have, for example, a three-sixteenths inch (4.766 mm.) wall which is merely a matter of choice. Aluminum is stated as the preferred material for the tube 10 as it is a heat conductor and offers economy, but other metal tubing could, of course, be used. Metal is suggested because of heat, abuse and abrasion but any tubing that will not deform at three hundred-fifty degrees Farenheit (177° C.) and not crack or break and withstand abrasion could be used. A portion has been broken away to show the wall of the tubular member.

The tubular member 10 is secured to a base 12 which is depicted as a sheet metal member bent into a channel form with out turned flange portions 14 in which are formed holes 16. Inside of this tube 10 is an electrical heater 20. This is a resistance element which conventionally is adapted for use with 110 volts A.C. This resistance element may have spaced fins, not shown, may be a silicone pad with wires therein or may be wound on an insulating core or otherwise protected from an electrical short or otherwise causing the metal member 10 to become an electrical conductor.

A cable 22 with a plug 24 is adapted to carry electric current to the electrical heater 20. A temperature indicator 26 visually displays the heat product in the metal member 10. This indicator shows the heat level in this metal sleeve and the user of the apparatus can visually check when the desired level or degree of heat is achieved.

In a separate control box 30 a cord or conductor 32 carries A.C. current, nominally 110 volts, to the control functions contained therein. A variable resistance or rheostat 34 is manipulated to produce the desired heat as developed in the resistance element 20. An "on-off"

switch 36 is employed to shut off or turn on current flow to the resistance element 20. An indicator light 38 is "on" when conductor 32 is plugged into an A.C. source and the switch 36 is "on" and plug 24 is inserted into outlet 40. This arrangement allows the plug 24 to be pulled to shut off flow to the electrical heater 20. Alternately with plug 24 in outlet 40 the switch 36 may be turned "on or off". Light 38 is illuminated only when current flows to the resistance electrical heater 20.

CIRCUIT DIAGRAM OF FIG. 2

Figure 2:
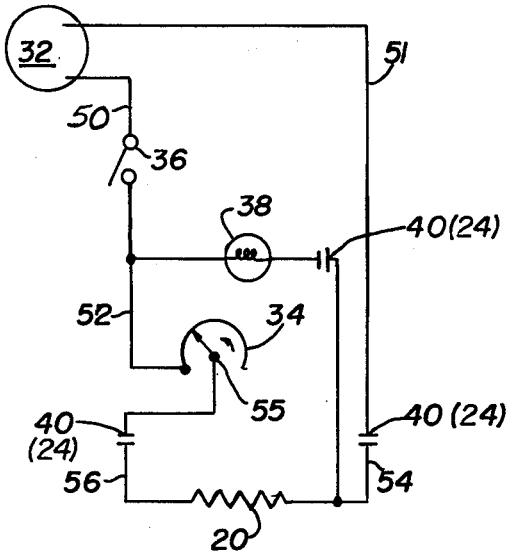
FIG. 2 represents the electrical circuit diagram of the apparatus of FIG. 1.

Referring next and finally to FIG. 2 there is shown an electrical diagram showing a preferred connection of the several elements in FIG. 1. Line or conductor 32 has one side 50 connected to switch 34. Light 38 is only illuminated when switch 34 is closed and the plug 24 is inserted into socket 40. Rheostat 34 is adjusted to increase the current flow to electrical heater 20. After plug 24 is inserted into receptacle 40, current flows through conductor 50 and closed switch 34 and thence through conductor 52 to one side of rheostat 34. Through and from movable contact 55 the controlled current flow goes to one end of heater 20. With the plug 24 inserted, the current flows through conductor 54 to resistor electrical heater 20. When switch 34 is closed and the plug 24 inserted, the light 38 is illuminated and maintains its brilliance no matter the adjustment of the rheostat 34.

The temperature indicator 26 is contemplated to be independent of the circuit but a temperature control device similar to the ones used in gas and electric ranges may be used in the circuit, if desired. In use, the tubular member 10 is secured to a workbench or the like by screws passed through holes 16. The cord 32 is plugged into a source of electricity. Plug 24 is inserted into outlet 40 and switch 36 is moved to the "on" position. The light 38 is illuminated. Rheostat 34 is adjusted so that the desired heating is achieved.

It is also to be noted that the above described apparatus also provides a method of forming laminated material into a tight curve or radius. The method includes the steps of: locally heating prior to forming of a laminated plastic member, said method including the steps of providing a relatively small tubular member adapted for repeated heating to at least three hundred degrees Farenheit and resistant to cracking and abrasion; positioning electrical heating means disposed within said tubular member and securing this heating means in close proximity to the tubular member so as to heat said tubular member as electrical current is fed thereto and therethrough; forming a base and securing said tubular member and said electrical heating means to said base in a substantially rigid manner; placing and maintaining the electrical heating means within the tubular member so as to maintain a close proximity without bringing the current flowing therethrough into conducting contact with the tubular member; bringing an electrical current from a supply source to and through the electrical circuit and to the electrical heating means; inserting a variable means in the electric circuit means, this variable means disposed for adjustment so as to increase and decrease the heat developed in the electrical heating means, and selectively connecting and disconnecting the electrical heating means from the source of electric current to provide current to heat the heating means at only a desired time period.

It is to be noted that many of the electrical components are commercially available and this is deliberately done so that repairs can be readily and economically made. When the term relatively small diameter is used, the diameter is usually two and one-half inches (63.5 mm.) or less.

Terms such as "left", "right", "up", "down", "bottom", "top", "front", "back", "in", "out", and the like are applicable to the embodiment shown and described in conjunction with the drawing. These terms are merely for the purposes of description and do not necessarily apply to the position in which the heating apparatus for locally forming laminated plastic may be constructed or used.

While a particular embodiment of the apparatus has been shown and described it is to be understood that modifications may be made within the scope of the accompanying claims and protection is sought to the broadest extent the prior art allows.

What is claimed is:

1. Apparatus for locally heating prior to the forming of a laminated plastic member, said apparatus including: (a) a relatively small rigid and heat conductive tubular member adapted for repeated heating to at least three hundred degrees Farenheit and resistant to cracking and abrasion; (b) a substantially rigid electrical heating means mounted within and along the length of the tubular member and fixed so as to be in close proximity to said tubular member and to heat said tubular member as electrical current is fed thereto and therethrough; (c) a base and means for securing said tubular member and said electrical heating means to this base in a substantially rigid manner; (d) means for placing and maintaining the electrical heating means within the tubular member so as to maintain a close proximity without bringing the current therethrough into conducting contact with the tubular member; (e) electrical circuit means for bringing electrical current from a supply source to the electrical heating means; (f) a variable means in the electric circuit means and disposed for adjustment so as to increase and decrease the heat developed in the electrical heating means, and (g) means for selectively connecting and disconnecting the electrical heating means from the source of electric current to provide current to heat the heating means at only a desired time period.

2. Apparatus for locally heating laminated plastic as in claim 1 in which the tubular member is of metal and the length is at least five inches in length.

3. Apparatus for locally heating laminated plastic as in claim 2 in which the tubular member is aluminum and the outside is not greater than two inches in diameter.

4. Apparatus for locally heating laminated plastic as in claim 1 in which the variable means to increase and decrease the temperature is a rheostat and the heating means is a resistance element.

5. Apparatus for locally heating laminated plastic as in claim 1 in which the electrical circuit means includes an "on-off" switch, an indicator light and a rheostat carried in a separate control box, and there is provided a plug and connector with appropriate conducting means whereby the tubular member and its associated heating means is removably and electrically connected to said control box.

6. Apparatus for locally heating laminated plastic as in claims 1, 2 or 5 in which there is also provided a temperature indicator to visually indicate that developed temperature in the tubular member.

7. Apparatus for locally heating laminated plastic as in claim 1 in which the base is a sheet metal, channel-shaped member with mounting flanges for securing this base to a workbench and the like.

* * * * *